United States Patent [19]

Iwata et al.

[11] Patent Number: 4,631,949

[45] Date of Patent: Dec. 30, 1986

[54] METHOD OF LOADING BILLET IN THE INDIRECT EXTRUDING PRESS

[75] Inventors: Masahiro Iwata; Teruhito Shirai; Toshio Watanabe, all of Oyama, Japan

[73] Assignee: Furukawa Aluminum Co., Ltd., Tokyo, Japan

[21] Appl. No.: 783,066

[22] Filed: Oct. 2, 1985

Related U.S. Application Data

[63] Continuation of Ser. No. 528,051, Aug. 31, 1983, abandoned.

[30] Foreign Application Priority Data

Aug. 31, 1982 [JP] Japan ..... 57-151577

[51] Int. Cl.[4] ..... B21C 31/00; B21C 33/00

[52] U.S. Cl. ..... 72/270; 72/273.5

[58] Field of Search ..... 72/253.1, 270, 273.5, 72/273

[56] References Cited

U.S. PATENT DOCUMENTS

| | | | |
|---|---|---|---|
| 3,184,944 | 5/1965 | Sibler | 72/70 |
| 3,528,275 | 9/1970 | Sibler | 72/273.5 |
| 3,649,816 | 3/1972 | Johnes et al. | 72/253.1 |
| 4,165,625 | 8/1979 | Wagner et al. | 72/273.5 |
| 4,223,546 | 9/1980 | Wagner et al. | 72/273.5 |

FOREIGN PATENT DOCUMENTS

| | | | |
|---|---|---|---|
| 2319036 | 10/1974 | Fed. Rep. of Germany | 72/273.5 |
| 3011134 | 10/1981 | Fed. Rep. of Germany | 72/273.5 |
| 14112 | 6/1968 | Japan | 72/270 |
| 28613 | 2/1982 | Japan | 72/273.5 |
| 250944 | 6/1926 | United Kingdom | 72/273.5 |

*Primary Examiner*—Lowell A. Larson

*Attorney, Agent, or Firm*—Armstrong, Nikaido, Marmelstein & Kubovcik

[57] ABSTRACT

A method of loading billet in the indirect extruding press for an alignment of the billet in which, after the billet (10) is held between the dummy block (11) at the side of the extruding stem (4) and the surface of the dies (6) of the dies stem (3), the container (1) is moved toward the side of the billet (10), thereby preventing the blockage of the billet and enabling the obtaining of pipes of a good roundness precision and a reduction in the thickness deflecting ratio of the pipes.

3 Claims, 10 Drawing Figures

METHOD OF LOADING BILLET IN THE INDIRECT EXTRUDING PRESS

This application is a continuation of application Ser. No. 528,051 filed Aug. 31, 1983, abandoned.

DETAILED DESCRIPTION OF THE INVENTION

Figure 1A:
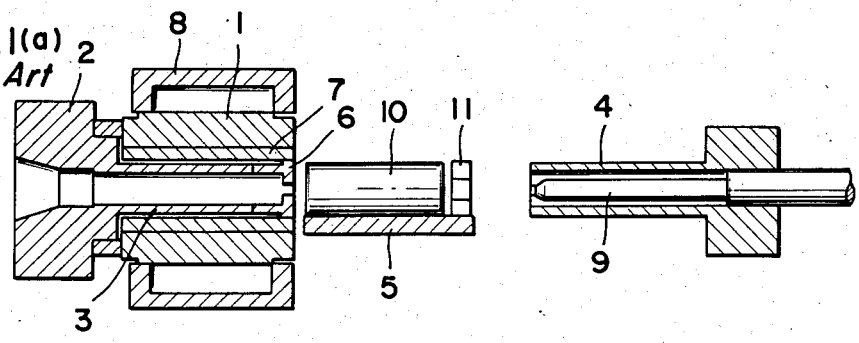
FIG. 1(a) Prior Art
FIGS. 1 (*a*)–(*d*) are illustrations showing the conventional processes of loading a billet in the conventional indirect extrusion press.
Figure 1B:
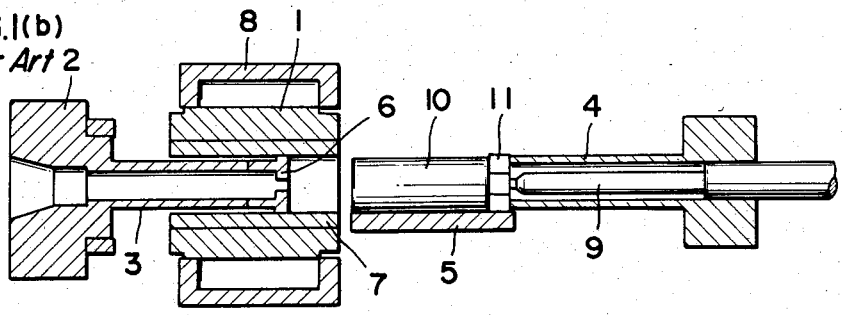
FIG. 1(b) Prior Art
Figure 1C:
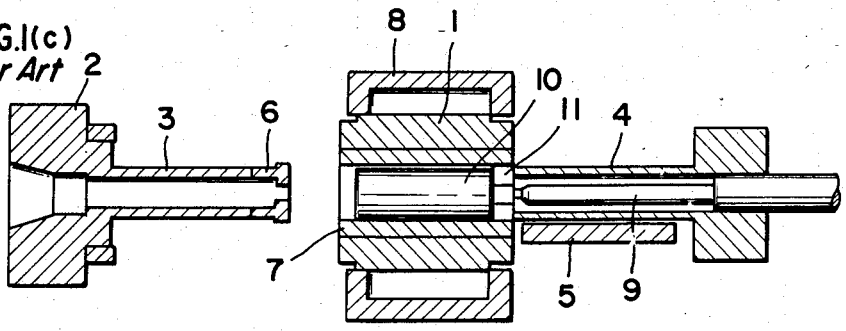
FIG. 1(c) Prior Art
Figure 1D:
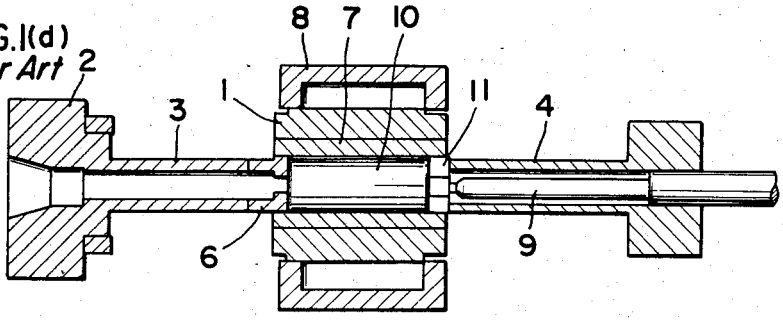
FIG. 1(d) Prior Art

The present invention relates to a method of loading billet into a container of the indirect metal extruding press.

As shown in FIG. 1 (*a*), the indirect metal extruding press as hitherto known comprises a container 1 movable in an axial direction, a die stem 3 fixed to an end-platen 2 at one side of the container 1, an extruding stem 4, movable in an axial direction, provided at the other side of the container 1, both stems being located on a coaxial line, and a billet loader 5 movable vertically i.e., transversely to the axial direction, and provided at the side closest to the extruding stem 4 of the container 1. Further, the indirect metal extruding press comprises a die 6 provided at an end of the die stem 3, the container 1 having a container sleeve 7 within an inner surface thereof and fitted to a casing 8, a billet loader 5 movable vertically transversely to its axial direction, provided at the side of the extruding stem 4 closest to the casing 8 and a mandrel 9 provided in the extruding stem 4.

In metal extruding by means of the indirect extruding press, as shown in FIG. 1 (*a*), the container 1 is moved onto the die stem 3, and the billet 10 and a dummy block 11 are put on the billet loader 5 so as to locate the dummy block 11 at the side of the extruding stem 4, then the billet loader 5 is moved so as to make the centers of the billet 10 and the dummy block 11 coaxial with the axis of the container 1. Then, as shown in FIG. 1 (*b*), the container 1 is moved toward the extruding stem or ram 4 so as to make the dummy block 11 come in contact with an end of the extruding stem 4 first and subsequently to make the billet 10 come in contact with the dummy block 11, and then the container 1 is further moved to load the billet 10 and the dummy block 11 into the container 1 as shown in FIG. 1 (*c*). Thereafter, the billet loader 5 is withdrawn from the extruding press. Next, as shown in FIG. 1 (*d*), the container 1 and the extruding stem 4 are moved toward the die stem 3 to carry out the extruding of the billet 10 through dies 6.

Figure 2:
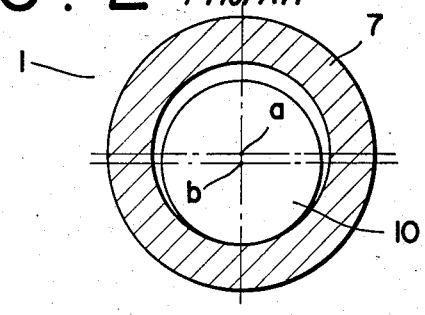
FIG. 2 Prior Art
FIG. 2 is a cross-section a billet loaded by the conventional method.

In the indirect extrusion procedure described above, the air existing in the gap between the outer surface of the billet and the inner surface of the container is apt to mix into the surface of the extruded material. Therefore, the gap must desirably be reduced to a minimum If the outer diameter of the billet is increased to reduce the gap between the outer surface of the billet and the inner surface of the container, a hot billet, for example, an aluminum billet heated to 400°–500° C., when loaded into the container, is caught there owing to contact between its lower surface and the bottom, of the container and takes a dumpling-like shape which may make its loading impossible. Furthermore, in pipe extrusion which employs a hollow billet provided with a hole in the center thereof, the axis (a) of the container 1 becomes offset from the center (b) of the billet 10 as shown in FIG. 2 during the loading of the billet into the container, thereby resulting in a failure to extrude pipes with a high degree of roundness.

In light of the above noted drawbacks, after much study and examination, we have developed a method of loading the billet into the container in the indirect extruding press which prevents the billet from clogging the container and makes it possible to extrude pipes of a satisfactory roundness. The method of the present invention is characterized in that in the loading of a billet into the indirect extruding press comprising a container movable in the axial direction thereof, a die stem fixed to an end-platen and provided on one side of the container, and an extruding stem movable in the axial direction thereof on the other side of the container, both systems being arranged on a coaxial line, and further a billet loader movable vertically across the axial direction of the container provided on the side of the extruding stem closest to the container, the container is moved onto the die stem and the center of the billet on the billet loader is brought coaxially in line with the container, the extruding stem is moved so as to hold the billet against the die surface of the die stem through the dummy block, and subsequently the billet loader is withdrawn from the extruding press, and thereafter the container is moved toward the side of the extruding stem, thereby loading the billet into the container.

Figure 3A:
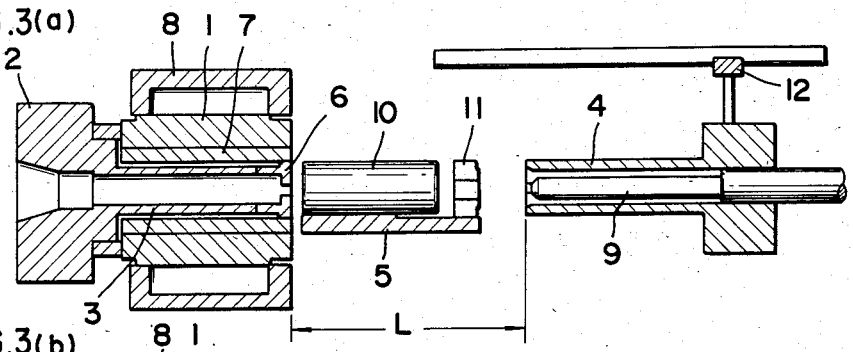
FIG. 3 (*a*)–(*c*) are illustrations showing the processes of loading a billet in accordance with this invention.
Figure 3B:
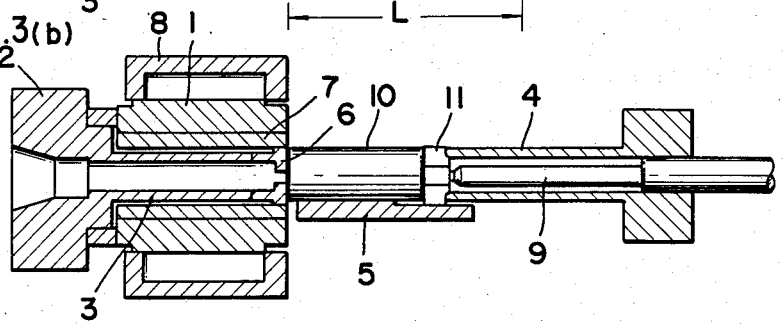
Figure 3C:
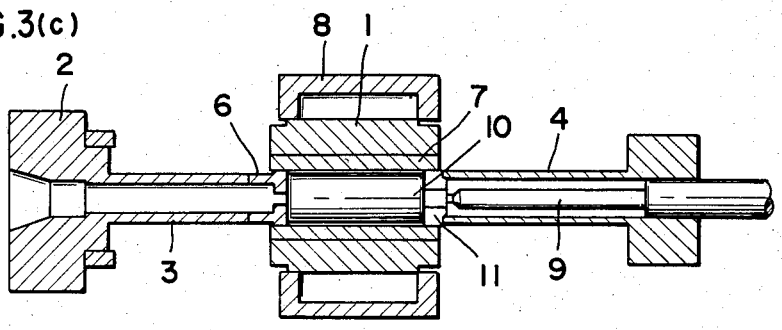
Figure 4:
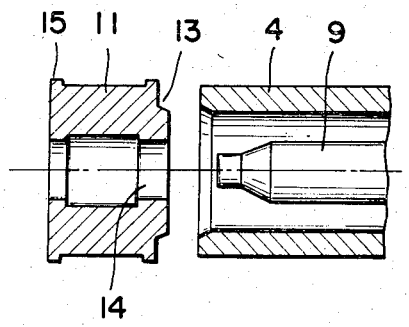
FIG. 4 is a cross-section of a dummy block (example).

In other words, according to this invention, the container 1 is moved onto the dies stem 3, and the billet 10 and the dummy block 11 located on the side of the extruding stem 4 closest to the billet 10 are placed on the billet loader 5, and then the centers of the billet 10 and the dummy block 11 are located on a coaxial line of the container 1 by means of moving the billet loader 5. Then, as shown in FIG. 3 (*b*), the extruding stem 4 is moved toward the container 1 and the billet 10 is held between the dies 6 provided at the end of the dies stem 3 and the extruding stem 4 through the dummy block 11 and thereafter the billet loader 5 is withdrawn from the extruding press. In connection with the above operation, the length of the billet 10 to be loaded into the container 1 is previously and automatically calculated and memorized in an electric control circuit mounted outside of the extruding press, and the billet 10 together with the dummy block 11 are placed on the billet loader 5 and moved into and within the extruding press so as to locate the centers of the billet 10 and the dummy block 11 on a coaxial line of the container 1, and thereafter the extruding stem 4 is moved. The movement of the extruding stem 4 is calculated by a linear scale 12 and stopped when it has reached the memorized length of the billet 10 and the dummy block 11, and thus the billet 10 and the dummy block 11 are held between the die 6 and the extruding stem 4. At this point, since an over-movement of the extruding stem 4 makes the loading of the billet 10 impossible and a short-movement of the stem drops the billet, the control of the operation is precisely managed. In this manner, the billet 10 and the dummy block 11 are held between the die 6 and the extruding stem 4 and then, as shown in FIG. 3 (*c*), the container 1 is moved toward the extruding stem 4 so that the billet 10 is loaded into the container 1 without contact with the inner surface of the sleeve 7 of the container 1 and the extruding process commences. Further, in FIG. 3 (*c*), numeral 2 indicates an end-platen fixed with the die stem 3, numeral 7 a sleeve provided within the container 1, numeral 8 a casing fitted with the container 1, and numeral 9 a mandrel for the pipe extruding. Still further, as shown in FIG. 4, when the dummy block 11 is provided with a connecting portion 13 and used with the mandrel 9, the dummy block 11 is provided with an inserting hole for the mandrel 9 and discs 15 at both ends thereof to slidably come in contact with an inner surface of the container 1 and so as to be connected with an end of the extruding stem 4.

Figure 5:
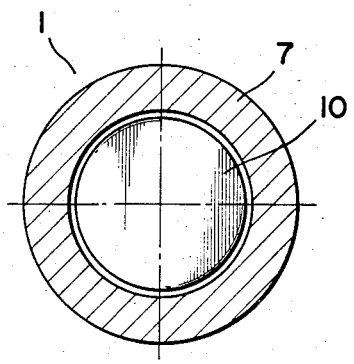
FIG. 5 is a cross-section of a billet loaded by the method of this invention.

According to the process of this invention, as shown in FIG. 5, the billet 10 is held by the die 6 and the extruding stem 4 without a discrepancy between the axis (a) of the container 1 and the center of the billet 10 and loaded into the container 1 so that the billet 10 is loaded without contact occurring with the sleeve 7 within the container 1. Further, the pipe-extruding working of billets so loaded also produces pipes of good roundness and precision.

The objects and aspects of this invention will be apparent from the following description of embodiments.

EXAMPLE 1

According to the conventional billet loading method shown in FIG. 1 and the billet loading method of this invention shown in FIG. 3, the pipe extruding operations were performed by loading the billet into the container to obtain respective pipes. Then, 50 pieces each of the respective pipes were measured on a thickness deflecting ratio. The results are indicated in Table 1.

The thickness deflecting ratio was calculated by the following formula.

$$\text{Thickness deflection ratio (\%)} = \frac{\text{Max. thickness} - \text{Min. thickness}}{\text{Mean thickness}} \times 100$$

TABLE 1

| | | | |
|---|---|---|---|
| Extruding material | 6063 | 6063 | 5056 |
| Billet temperature (°C.) | 480 | 480 | 440 |
| Pipe size (mm) (diameter × thickness) | 53 × 4 | 150 × 10 | 120 × 20 |
| Method of this invention (%) | | | |
| Head | 14.4 | 7.0 | 6.5 |
| Middle | 8.3 | 4.7 | 4.5 |
| Bottom | 7.1 | 4.3 | 4.0 |

EXAMPLE 2

Next, according to the conventional billet loading method shown in FIG. 1 and the billet loading method of this invention shown in FIG. 3, the diameter of a billet that can be inserted into a container sleeve of 330 mm inner diameter and a dumpling formation ratio at a time when the former billet of the above diameter is inserted into the latter container sleeve were investigated. The results are indicated in Table 2.

The dumpling formation ratio was calculated on the following basis.

$$\text{Formation ratio} = \frac{\text{No. of pieces of dumpling-like shape}}{\text{No. of extruded pieces}} \times 100$$

TABLE 2

| | Method of this invention | Conventional method |
|---|---|---|
| Inner diameter of sleeve (mm) | 330 | 330 |
| Outer diameter of billet (mm) | 327 | 320 |
| Dumpling formation ratio (%) | 0 | 16 |

As stated above, this invention facilitates billet loading into the container sleeve and reduces a gap between the inner diameter of the sleeve and the outer diameter of the billet during a hot condition, thereby preventing the air from mixing into the surface of the extruded products, and thereby further enhancing the roundness precision of the products.

What is claimed is:

1. A method of loading a billet in an indirect extruding press including a container movable along a direction of a central axis thereof, said container being fitted to a casing and having a container sleeve disposed therewithin, a die stem fixed to an end platen disposed at one side of said container, a die having a die surface and being provided at an end of said die stem opposite said end platen, an extruding stem disposed at the other side of said container opposite said die stem and movable along said axial direction of said container, respective central axes of said container sleeve, said die stem and said extruding stem being coaxial, a dummy block slidably insertable within and fitting said container sleeve, said dummy block being provided at one end thereof with a connecting portion for connecting said dummy block with a connecting end of said extruding stem, and a billet loader for supporting a billet to be loaded and said dummy block, said billet loader being movable in a direction transverse to said central axial direction of said container and disposed at said other side of said container, the method comprising the steps of:

moving said container toward and onto said die stem so that said die surface of said die is brought flush with an end of said container sleeve closest to said extruding stem;

supporting a billet to be loaded and said dummy block on said billet loader, said dummy block being located closest to said extruding stem with said connecting portion of said dummy block located closest to said end of said extruding stem, said billet being supported at a higher level than said dummy block so as to make respective central axes of said billet and said dummy block coaxial;

moving said billet loader into and within said indirect extruding press and opposite said die stem such that said central axes of said billet and dummy block supported thereupon are made coaxial with said central axis of said container sleeve and extruding stem;

moving said extruding stem toward said die stem to bring said connecting end of said extruding stem into connecting contact with said connecting portion of said dummy block;

further moving said extruding stem, having said dummy block connected therewith, toward said die stem until said billet is held with its central axis maintained coaxial with that of said container sleeve and between said die surface of said die on said die stem and said dummy block connected with said extruding stem, without said billet entering said container sleeve;

withdrawing said billet loader from said indirect extruding press; and moving said container towards said extruding stem so as to load said billet and said dummy block into said container sleeve therewithin.

2. A method of loading a billet in an indirect extruding press including a container movable along a direction of a central axis thereof, said container being fitted to a casing and having a container sleeve disposed therewithin, a die stem fixed to an end platen disposed at one side of said container, a die having a die surface and being provided at an end of said die stem opposite said end platen, an extruding stem disposed at the other side of said container opposite said die stem and movable along said axial direction of said container, respective central axes of said container sleeve, said die stem and said extruding stem being coaxial, a dummy block slidably insertable within and fitting said container sleeve, and a billet loader for supporting a billet to be loaded and said dummy block, said billet loader being movable in a direction transverse to said central axial direction of said container and disposed at said other side of said container, the method comprising the steps of:

measuring the length of a billet to be loaded;

moving said container toward and onto said die stem so that said die surface of said die is brought flush with an end of said container sleeve closest to said extruding stem;

supporting said billet to be loaded and said dummy block on said billet loader, said dummy block being located closest to said extruding stem, said billet being supported at a higher level than said dummy block so as to make respective central axes of said billet and said dummy block coaxial;

moving said billet loader into and within said indirect extruding press and opposite said die stem such that said central axes of said billet and dummy block supported thereupon are made coaxial with said central axis of said container sleeve;

moving said extruding stem toward said die stem until a distance between said extruding stem and said die surface of said die on said die stem is equal to said measured length of said billet to be loaded and the length of said dummy block, so that said billet and dummy block are held with their said central axes maintained coaxial with that of said container sleeve and between said die surface of said die and said extruding stem with said dummy block being held to said billet by said extruding stem, and without said billet entering said container sleeve;

withdrawing said billet loader from said indirect extruding press; and moving said container towards said extruding stem so as to load said billet and said dummy block into said container sleeve therewithin.

3. A method of loading a billet into an indirect extruding press in accordance with either claim 2 or 1, wherein said container is moved towards said extruding stem so as to load said billet and said dummy block into said container sleeve without contact occurring between said billet and said container sleeve.

* * * * *